US005544026A

United States Patent [19]

Holbrook

[11] Patent Number: 5,544,026

[45] Date of Patent: Aug. 6, 1996

[54] RUNNING LIGHTS FOR IN-LINE ROLLER SKATES

[76] Inventor: Gary D. Holbrook, 7871 E. Topeka Pl., Yuma, Ariz. 85365

[21] Appl. No.: 460,278

[22] Filed: Jun. 2, 1995

[51] Int. Cl.[6] ..... F21L 15/08

[52] U.S. Cl. ..... 362/103; 362/61

[58] Field of Search ..... 362/103, 61; 36/137

[56] References Cited

U.S. PATENT DOCUMENTS

| | | | |
|---|---|---|---|
| 4,367,515 | 1/1983 | Beard | 362/103 |
| 4,438,482 | 3/1984 | Leon et al. | 362/103 |
| 4,463,412 | 7/1984 | Broach | 362/61 |
| 4,712,319 | 12/1987 | Goria | 36/137 |
| 4,848,009 | 3/1988 | Rodgers | 36/137 |
| 4,991,066 | 2/1991 | McCowan | 362/61 |
| 4,997,196 | 3/1991 | Wood | 362/61 |
| 5,033,212 | 7/1991 | Evanyk | 362/103 |
| 5,327,329 | 7/1994 | Stiles | 362/61 |
| 5,381,615 | 1/1995 | MacMillan | 362/103 |
| 5,473,518 | 12/1995 | Haber et al. | 362/103 |
| 5,484,164 | 1/1996 | McInerney et al. | 362/103 |

FOREIGN PATENT DOCUMENTS

| | | | |
|---|---|---|---|
| 1253832 | 5/1989 | Canada | 36/137 |
| 2643794 | 9/1990 | France . | |

*Primary Examiner*—Denise L. Gromada
*Assistant Examiner*—Alfred Basichas
*Attorney, Agent, or Firm*—Richard C. Litman

[57] ABSTRACT

Running lights for in-line roller skates comprise head-lights, a side-light and a rear light. The head-lights provide a beam of adjustable intensity. Mounting of the running lights on a skate is easy because a central region of the running lights is made up of stretchable cords. There is also a toe strap and a rear anchor portion that loops over a brake projection or attaches to a heel portion of a skate, as by hook-and-loop fasteners.

20 Claims, 5 Drawing Sheets

RUNNING LIGHTS FOR IN-LINE ROLLER SKATES

BACKGROUND OF THE INVENTION

1. Field of the Invention

The present invention relates generally to traveling lights, and more particularly to lights for use with in-line roller skates.

2. Description of the Prior Art

Roller skating at night or near dusk is an exciting but potentially dangerous activity. Recognizing this fact, inventors have tried to provide lights for roller skates, but have failed to provide lights that are genuinely easy to apply to, and remove from, a variety of skates.

U.S. Pat. No. 4,367,515, issued on Jan. 4, 1983, to Steven F. Beard, describes a roller skate light attachment that mounts on a stop portion of a roller skate. There is no provision for mounting the attachment on a skate not having a stop portion.

U.S. Pat. No. 4,463,412, issued on Jul. 31, 1984, to Ronald W. Broach, describes an illuminated shoe skate attachment. The attachment mounts to bolts or ridges on a skate by use of a complicated set of brackets. The attachment is detachable for use on other skates, but only if the brackets fit the other skates.

U.S. Pat. No. 4,991,066, issued on Feb. 5, 1991, to Gregory L. McCowan, describes an adaptor kit for providing lighting for a skateboard. The lighting replaces a part ordinarily present on a skateboard and is thus unsuitable for use with roller skates.

U.S. Pat. No. 4,997,196, issued on Mar. 5, 1991, to John L. Wood, describes a system in which lights are mounted in grooves in a skateboard or in skid bars in a skateboard. There is no provision for mounting lights on roller skates.

U.S. Pat. No. 5,033,212, issued on Jul. 23, 1991, to Walter R. Evanyk, describes a lighting system which is mounted to objects such as shoes by use of hook-and-loop fasteners. There is no use of stretchable cord to ensure an easy and lasting engagement of the lighting system with an object to which it is attached.

U.S. Pat. No. 5,327,329, issued on Jul. 5, 1994, to David L. Stiles, describes lighting attachments for in-line skates that are frictionally and adhesively mounted. There is no use of stretchable cord to ensure an easy and lasting engagement of the lighting system with an object to which it is attached.

Canadian Patent Document No. 1 253 832, issued on May 9, 1989, to Nicholas A. Rodgers, describes lights for footwear. There is an internally disposed switch that responds to movement of a wearer. There is no provision for mounting lights on roller skates.

French Patent Document No. 2 643 794, issued on Sep. 7, 1990, to Jean Leonard Darfeuille, describes head-lights for footwear. There is an internally disposed switch that senses presence of a wearer. There is no provision for mounting lights on roller skates.

None of the above inventions and patents, taken either singly or in combination, is seen to describe the instant invention as claimed.

SUMMARY OF THE INVENTION

Running lights for in-line roller skates according to the present invention preferably comprise head-lights, a side-light and a rear light. The head-lights provide a beam of adjustable intensity. Mounting of the running lights on a skate is easy because a central region of the harness is made up of stretchable cords. There is also a toe strap and a rear anchor portion that loops over a brake projection or attaches to a heel portion of a skate, as by hook-and-loop fasteners. A power pack has a battery that is easily insertable into, and removable from, the running lights for ease of replacement.

Accordingly, it is a principal object of the invention to provide lights for mounting on a skate which can easily be placed on, and removed from, the skate.

It is another object of the invention to provide a power pack for skate-lights including a battery that is easily insertable into, and removable from, the running lights for ease of replacement.

It is a further object of the invention to provide adjustable head-light intensity in skate-lights.

Still another object of the invention is to provide adaptable attachment to a heel portion of a skate, regardless of whether the heel portion has an attached brake projection.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Excitement without a modicum of danger is like roller skates without wheels. However, unnecessary, excessive danger can change an exciting evening of skating into a trip to the hospital. Skaters who enjoy the excitement of skating in darkness need lighted skates to avoid the unnecessary, excessive danger inherent in night-time skating with lightless skates. The present invention provides lights for skates, in a form that is easy to install and easy to remove. Moreover, a single sample of the invention can be used with a variety of skates.

Figure 1:
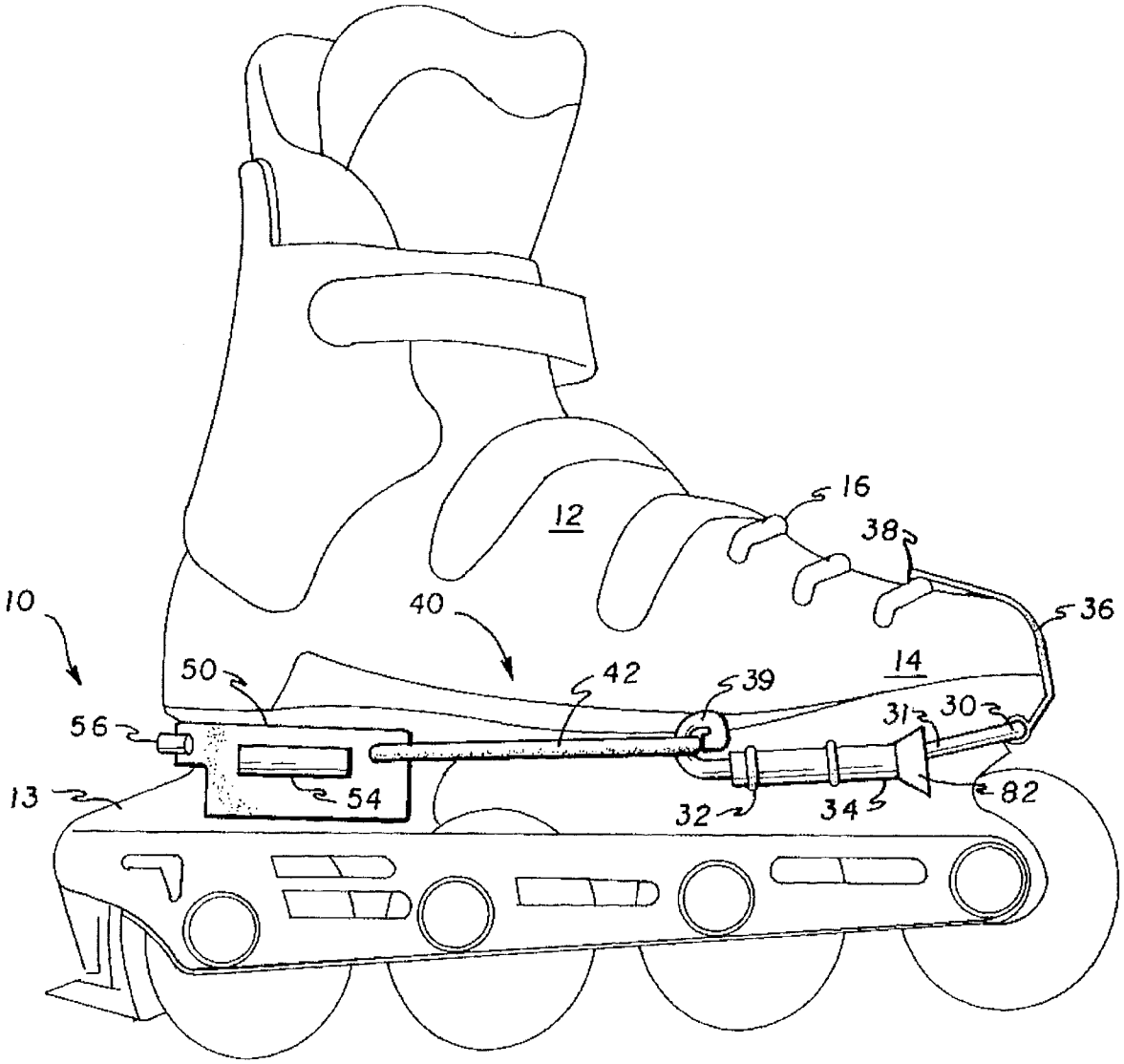
FIG. 1 is an environmental, perspective view of the present invention in place on an in-line roller skate.
Figure 2:
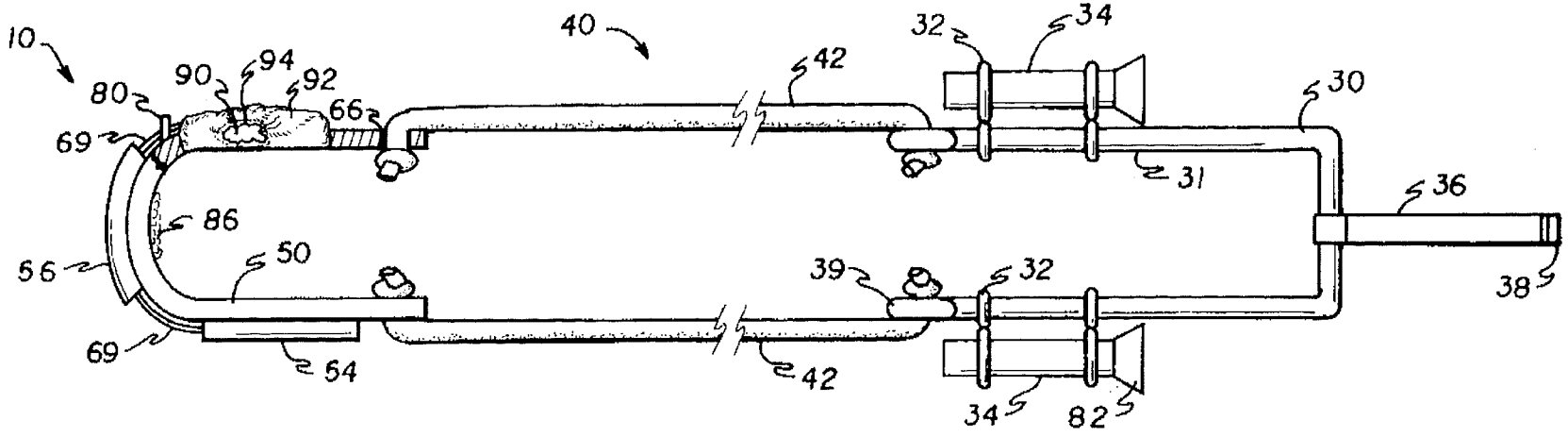
FIG. 2 is a top, perspective, cutaway view of a first embodiment of the present invention.
Figure 3:
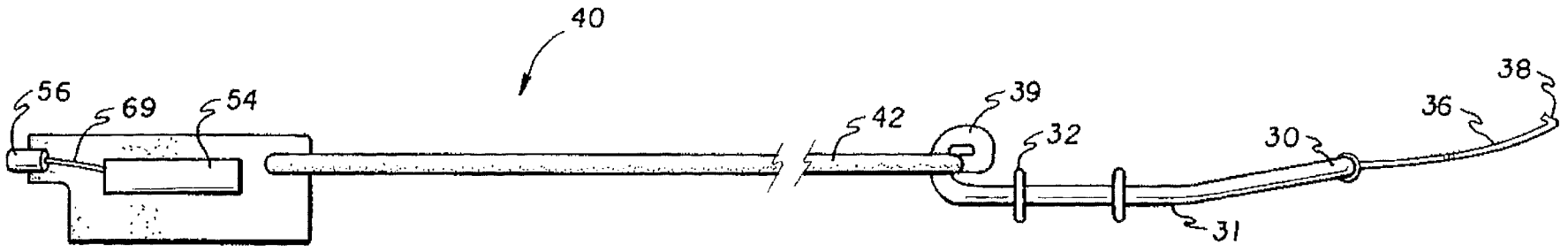
FIG. 3 is a side, elevational view of a first embodiment of the present invention.
Figure 8:
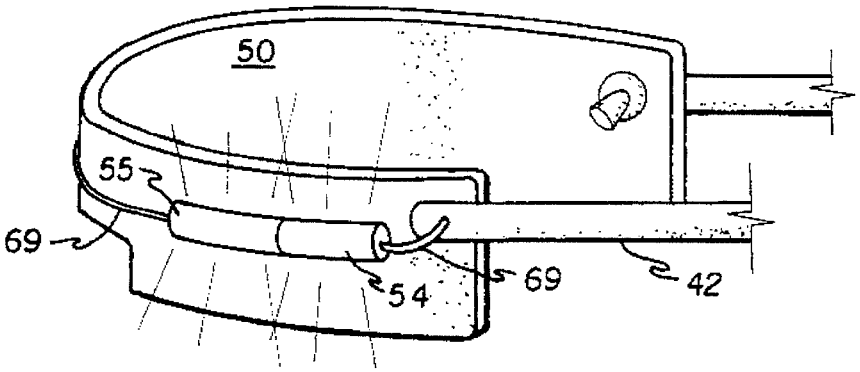
FIG. 8 is a partial perspective detail view of an alternate light arrangement for use with either the first embodiment, the second embodiment, or the third embodiment of the present invention.

Referring to the drawings, running lights 10 for in-line skates 12, according to the present invention, include headlights 34, a side-light 54 and a heel-light 56, as shown in FIG. 2. Alternately, the running lights 10 may include two side-lights 54, 55, as shown in FIG. 8, instead of having a side-light 54 and a heel-light 56, as shown in FIG. 2.

The running lights 10 also include a front portion 30, a central portion 40, and a rear portion 50. The front portion 30 of the running lights 10 is U-shaped and constructed of durable material of known type. The front portion 30 has integral attachment means 32, such as circular clips 32 of known type, for attaching at least one headlight, preferably a pair of cylindrical headlights 34. A flexible region 31 of the front portion 30 adjusts under manual pressure to change shape, thereby allowing for snug fit of the front portion 30 to a variety of skates 12. Because of the flexible region 31, the front portion 30 may be located underneath the skate 12, as shown, or can be hung over a front part of the skate 12. The front portion 30 also has an attached toe strap 36 with a hook 38 for binding the front portion 30 to a front part 14 of a skate 12, by hooking onto closure members 16, such as laces, of a skate 12. There are integral anchor members 39 which frictionally bind the front portion 30 to the central portion 40. The anchor members 39 can be cylindrical, around which hollow members 42 can be disposed and frictionally engaged, or the anchor members 39 can be ring-like.

Figure 5:
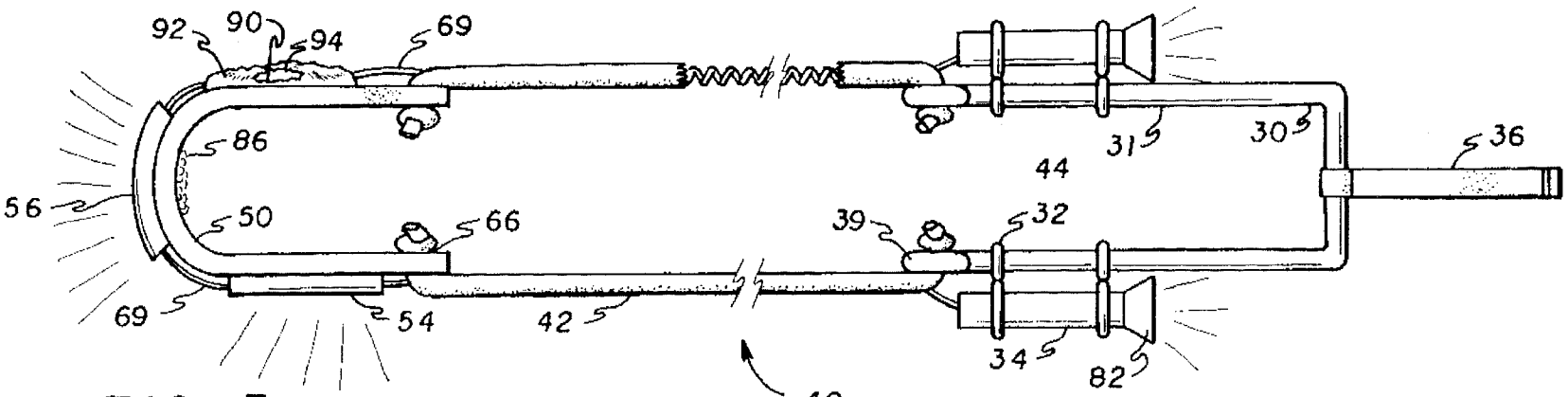
FIG. 5 is a top, perspective view of a second embodiment of the present invention.
Figure 6:
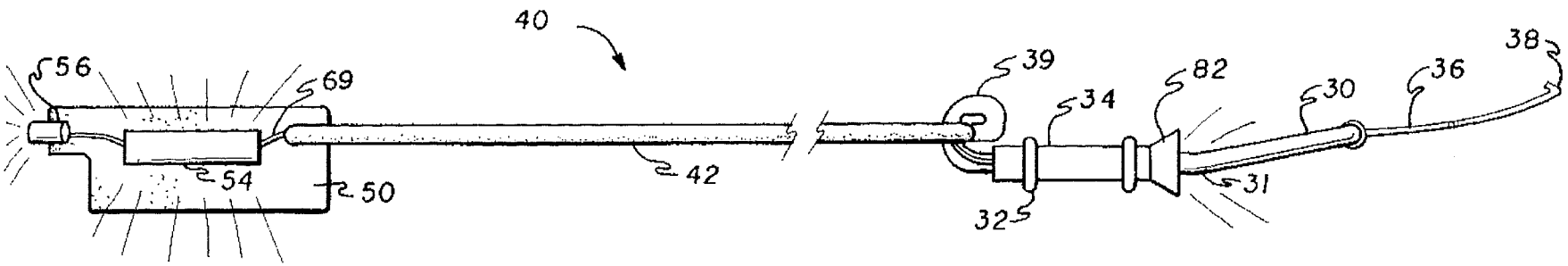
FIG. 6 is a side, elevational view of a second embodiment of the present invention.
Figure 4:
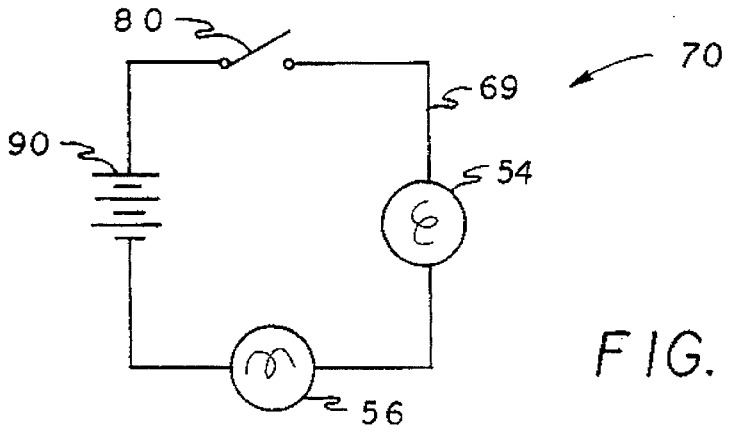
FIG. 4 is a circuit diagram showing the circuitry of a first embodiment of the present invention.
Figure 9:
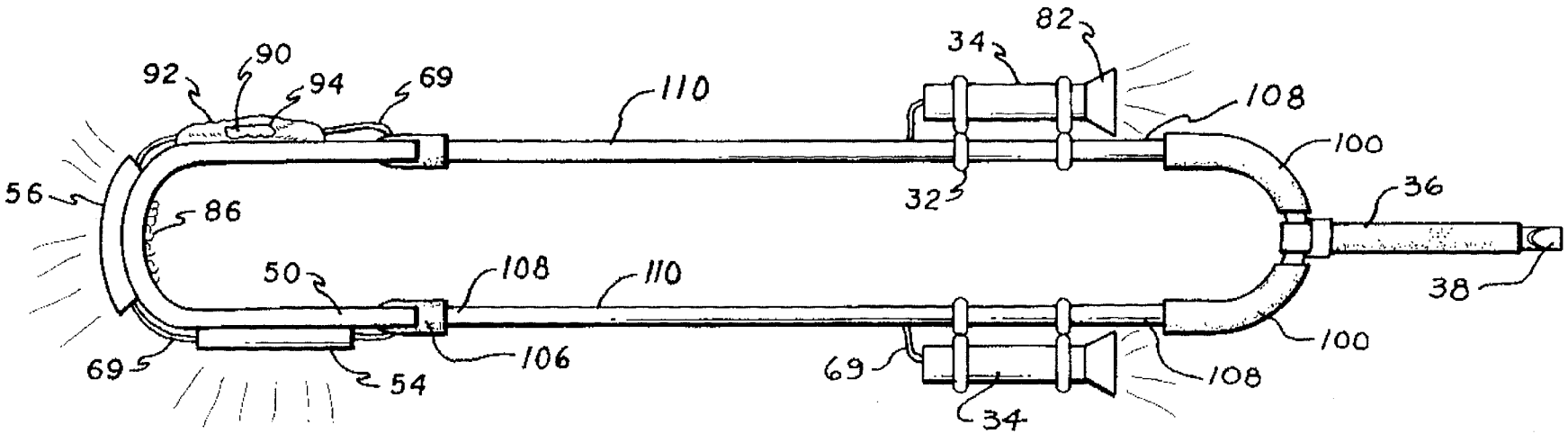
FIG. 9 is a top, perspective view of a third embodiment of the present invention.

The central portion 40 of the running lights 10 in a first embodiment of the invention, shown in FIGS. 1–4, includes dual elastomeric cords 42, preferably latex, either hollow or solid, that connect the front portion 30 and rear portion 50 of the running lights 10. In the second embodiment of the invention, shown in FIGS. 5–7, the cords 42 are hollow, with inner diameter sufficient to allow passage of a coiled wire 44. The elastomeric nature of these cords 42 allows variation of the distance between, and orientation of, the front portion 30 and rear portion 50 relative to one another. In both the first embodiment and the second embodiment of the invention, the cords 42 preferably attach at the anchor members 108 in the front portion 30 and in the heel portion 50. Preferably, this attachment is accomplished by frictional engagement of a hollow cord 42 of the central portion 40 around a cylindrical anchor member 108, as shown in FIG. 9. Alternately, this attachment can be accomplished via terminal knots 43 anchoring the central portion 40 in ring-like anchor members 39 in the front portion 30 and in apertures 66 in the heel portion 50.

In a first embodiment of the invention, the headlights 34 are conventional flashlights 34, with internal power supplies (not shown), power-switches (not shown) of known type, and preferably with adjustable lenses 35 of known type for varying light intensity. In this first embodiment of the invention, there is a separate electrical series circuit 70, shown in FIG. 4, that supplies the side-light 54 and the heel-light 56, or the two side-lights 54, 55, as applicable. This circuit is controlled by a heel switch 80. In the circuit 70, there are a battery 90, a switch 80, a side-light 54, and a heel-light 56 or second side-light 55, all connected by wire 69, all components being of known type.

Figure 7:
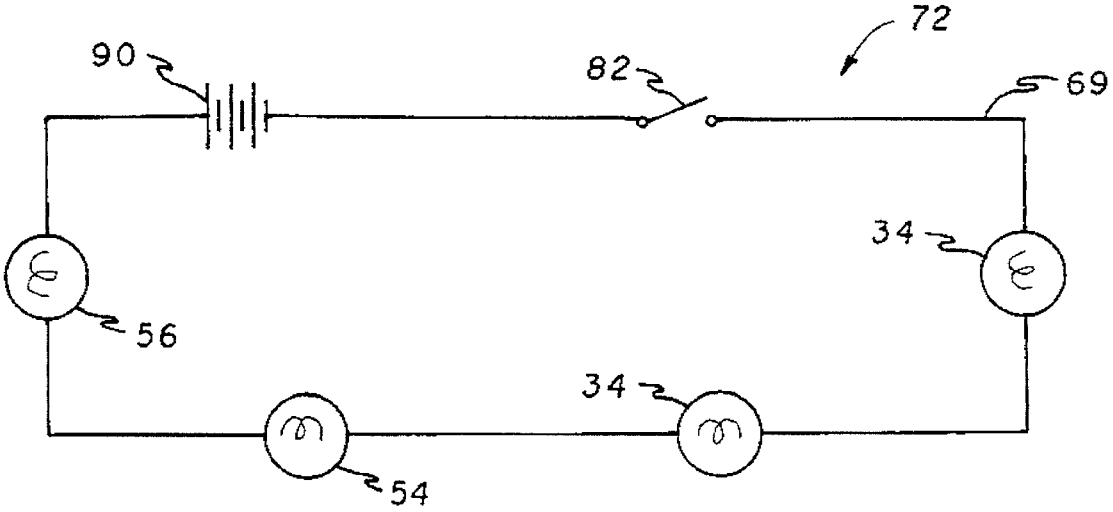
FIG. 7 is a circuit diagram showing the circuitry of a second embodiment of the present invention.

In a second embodiment of the invention, the headlights 34 are connected in series with an electrical circuit 72, shown in FIG. 7, that also supplies the side-light 54 and the heel-light 56, or the two side-lights 54, 55, as applicable. In this embodiment, the circuit can be switched off by a front switch 82 at one of the headlights 34. In the circuit 72, depicted diagrammatically in FIG. 7, there are a battery 90, a switch 82, and two headlights 34, a side light 54, and a heel light 56 or second side light 55, all connected by wire 69, all components being of known type.

Figure 10:
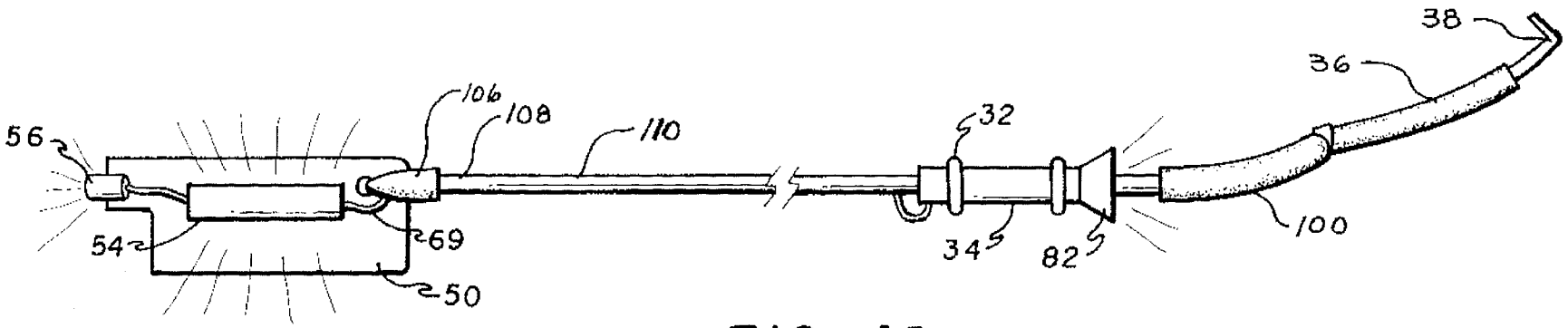
FIG. 10 is a side, elevational view of a third embodiment of the present invention.

A third embodiment of the invention is shown in FIGS. 9 and 10. In this third embodiment, the headlights 34 can be connected in series with an electrical circuit 72, shown in FIG. 7, as in the second embodiment, or the headlights 34 can be conventional flashlights 34, with a separate electrical series circuit 70, shown in FIG. 4, as in the first embodiment. The third embodiment of the invention differs from the first two embodiments in that the third embodiment has alternate front and central portions, as discussed below.

In both the first embodiment and second embodiment, the heel portion 50 of the running lights 10 is flexible and U-shaped, preferably of a durable material, such as leather. The heel portion 50 rests on a brake member 13 of a skate 12. Alternately, or in addition, the heel portion 50 can be held in place by use of hook-and-loop fasteners 86 disposed on the heel portion 50 and a rear surface (not shown) of the skate 12. The heel portion 50 also has a power pack 92 that holds a battery 90 of known type to power the lights 54, 55, 56, 34, as applicable. The power pack 92 is disposed adjacent to the heel portion 50, or within the heel portion 50, and preferably has an elastic casing 94 that allows insertion and removal of the battery 90, while also keeping the battery 90 in place during use of the skate 12.

In the third embodiment of the invention there is an alternate front portion 100 and an alternate central portion 110. The alternate front portion 100 has hollow elastomeric tubing or cords 42, preferably constructed of latex. The alternate central portion 110 is durable, flexible material of known type. The alternate front portion 100 is connected to the alternate central portion 110 by frictional engagement. Specifically, a cylindrical anchor members 108 on the alternate central portion 110 are frictionally engaged by the cords 42 of the alternate front portion 110 and anchor cords 106 connected by known means to the heel portion 50. The cords surround and grip the anchor member 108. The other elements of the third embodiment are as in the first embodiment (FIGS. 1–4), as shown in FIG. 9, or as in the second embodiment (FIGS. 5–7), with the alternate front portion 100 and the alternate central portion 110 replacing the front portion 30 and the central portion 40, respectively. The headlights 34, however, are mounted on the alternate central portion 110, rather than on the alternate front portion 100. The lighting of the heel portion 50 can also be as shown in FIG. 8.

It is to be understood that the present invention is not limited to the embodiments described above, but encompasses any and all embodiments within the scope of the following claims.

I claim:

1. Running lights for in-line roller skates, comprising:

a generally U-shaped front portion having an attached toe strap, two integral anchor members, and integral means for mounting at least one headlight;

a central portion; and a generally U-shaped heel portion having apertures through said heel portion and at least one light connected to said heel portion;

said central portion having dual elastomeric cords connecting said two integral anchor members of said front portion to said apertures of said heel portion.

2. The running lights according to claim 1, wherein said anchor members are ring-like.

3. The running lights according to claim 1, wherein said elastomeric cords are hollow.

4. The running lights according to claim 3, wherein said elastomeric cords are dimensioned and configured to contain coiled electrical wires.

5. The running lights according to claim 1, wherein said at least one headlight is a pair of cylindrical flashlights.

6. The running lights according to claim 1, further including a power pack connected to said rear portion, said power pack releasably holding a battery, said battery connected in series with said at least one light.

7. The running lights according to claim 1, further including:

a pair of cylindrical lights mounted in said means for mounting at least one headlight;

a power pack connected to said rear portion, said power pack releasably holding a battery, said battery connected in series with said at least one light connected to said heel portion and with said pair of cylindrical lights.

8. The running lights according to claim 1, wherein said heel portion is dimensioned and configured to rest on a brake member of a skate.

9. The running lights according to claim 1, further including hook-and-loop fasteners disposed on the heel portion.

10. The running lights according to claim 1, further including a hook connected to said toe strap, whereby said toe strap is attached to a closure member of a skate.

11. Running lights for in-line roller skates, comprising:

a generally U-shaped front portion having an attached toe strap;

a central portion having two integral anchor members and integral means for mounting at least one headlight; and a generally U-shaped heel portion having apertures through said heel portion and at least one light connected to said heel portion;

said front portion having at least one elastomeric cord connecting said two integral anchor members of said central portion.

12. The running lights according to claim 11, wherein said anchor members are cylindrical.

13. The running lights according to claim 12, wherein said at least one elastomeric cord is hollow.

14. The running lights according to claim 13, wherein said at least one elastomeric cord is dimensioned and configured to frictionally engage said anchor members.

15. The running lights according to claim 11, wherein said at least one headlight is a pair of cylindrical flashlights.

16. The running lights according to claim 11, further including a power pack connected to said rear portion, said power pack releasably holding a battery, said battery connected in series with said at least one light.

17. The running lights according to claim 11, further including:

a pair of cylindrical lights mounted in said means for mounting at least one headlight;

a power pack connected to said rear portion, said power pack releasably holding a battery, said battery connected in series with said at least one light connected to said heel portion and with said pair of cylindrical lights.

18. The running lights according to claim 1, wherein said heel portion is dimensioned and configured to rest on a brake member of a skate.

19. The running lights according to claim 1, further including hook-and-loop fasteners disposed on the heel portion.

20. The running lights according to claim 1, further including a hook connected to said toe strap, whereby said toe strap is attached to a closure member of a skate.

* * * * *